US006296223B1

(12) United States Patent
Grosskopf

(10) Patent No.: US 6,296,223 B1
(45) Date of Patent: Oct. 2, 2001

(54) HANGER LABEL

(75) Inventor: Glenn A. Grosskopf, Lake Zurich, IL (US)

(73) Assignee: Pharmagraphics (Southeast) L.L.C., Greensboro, NC (US)

( * ) Notice: Subject to any disclaimer, the term of this patent is extended or adjusted under 35 U.S.C. 154(b) by 0 days.

(21) Appl. No.: 09/327,719

(22) Filed: Jun. 8, 1999

(51) Int. Cl.[7] ..... A47G 29/00

(52) U.S. Cl. ..... 248/683; 248/311.3; 248/205.3; 40/630; 215/399

(58) Field of Search ..... 248/683, 205.3, 248/311.3; 40/310, 630, 617, 622, 907; 215/399; 239/81; 283/81, 79, 80

(56) References Cited

U.S. PATENT DOCUMENTS

| | | | | |
|---|---|---|---|---|
| 2,135,236 | | 11/1938 | Koppelman | 229/90 |
| 2,196,323 | * | 4/1940 | Norton | 215/399 X |
| 2,362,523 | | 11/1944 | Armstrong, Jr. et al. | 215/1 |
| 2,635,604 | | 4/1953 | Fredrickson | 128/272 |
| 3,016,224 | | 9/1962 | Hall | 248/205 |
| 3,231,919 | | 2/1966 | MacDonald | 15/174 |
| 3,387,732 | | 6/1968 | Jellies | 215/100 |
| 3,395,882 | * | 8/1968 | Marshall | 248/318 |
| 3,402,910 | | 9/1968 | Purvis | 248/318 |
| 3,623,633 | | 11/1971 | Kinn | 220/94 R |
| 3,635,367 | | 1/1972 | Morita et al. | 215/100 A |
| 3,744,658 | | 7/1973 | Fujio | 215/100 A |
| 3,851,790 | | 12/1974 | Kasper | 220/85 R |
| 3,869,333 | | 3/1975 | McMaster | 161/39 |
| 3,884,443 | | 5/1975 | McMaster | 248/467 |
| 4,306,662 | | 12/1981 | Sciortino et al. | 215/399 |
| 4,396,128 | | 8/1983 | Larson et al. | 215/399 |
| 4,460,143 | | 7/1984 | Ohama | 248/359 |
| 4,462,538 | | 7/1984 | Gendron | 229/68 R |
| 4,539,766 | | 9/1985 | Fast | 40/22 |
| 4,779,367 | | 10/1988 | Fast | 40/657 |
| 4,796,937 | | 1/1989 | Andrea . | |
| 4,832,301 | | 5/1989 | Hiramoto et al. | 248/359 |
| 4,847,130 | | 7/1989 | Cooper | 428/40 |
| 4,948,000 | | 8/1990 | Grabenkort | 215/12.2 |
| 5,135,125 | | 8/1992 | Andel et al. | 215/100 |
| 5,290,083 | | 3/1994 | Rissley | 294/87.2 |
| 5,389,415 | * | 2/1995 | Kaufmann | 283/81 X |
| 5,417,365 | | 5/1995 | Lindsay | 229/117 |
| 5,490,658 | | 2/1996 | Coward et al. | 248/683 |
| 5,542,634 | | 8/1996 | Pomerantz | 248/214 |
| 5,738,381 | | 4/1998 | Treleaven et al. | 283/81 |
| 5,782,495 | | 7/1998 | Grosskopf et al. | 281/81 |

FOREIGN PATENT DOCUMENTS

| | | | |
|---|---|---|---|
| 408315 | 2/1966 | (DE) . | |
| 28 06 391 A1 | 2/1978 | (DE) . | |
| 3631-021-A | 9/1986 | (DE) . | |
| 43 21 572 A1 | 1/1995 | (DE) | G09F/3/02 |
| 0 390 952 B1 | 6/1994 | (EP) | G09F/3/02 |
| 0 356 574 B1 | 11/1994 | (EP) | G09F/3/02 |
| 1460738 | 10/1966 | (FR) . | |
| 1175296 | 12/1969 | (GB) . | |
| 309950 | 3/1973 | (GB) | F16L/3/02 |

* cited by examiner

*Primary Examiner*—Ramon O. Ramirez
*Assistant Examiner*—Gwendolyn Baxter
(74) *Attorney, Agent, or Firm*—Myers Bigel Sibley & Sajovec

(57) ABSTRACT

A label for suspending an article from a support has a lower surface and includes an adhesive on the lower surface to secure the label to the article. The label further includes a hanger defining an opening therein and an interlock tab. The interlock tab is adapted to selectively engage the opening to interlock with the hanger to form a hanging loop including the hanger and the interlock tab. A molded suspendable assembly includes a molded article and an in-mold label secured to the article. The label includes a hanger defining an opening therein.

24 Claims, 12 Drawing Sheets

HANGER LABEL

FIELD OF THE INVENTION

The present invention relates to devices for suspending articles, and more particularly, to labels including hangers and securable to articles.

BACKGROUND OF THE INVENTION

It is often necessary or desirable to hang various articles from supports for storage and convenient access. For example, IV bottles and bags often must be suspended from stands for gravitational feed of the contents of the bottles or bags. Similarly, consumers often wish to hang bottles of shampoo, soap, suspension oils and the like in their showers or elsewhere. A number of hanging devices for such purposes have been proposed, including self-adhesive labels including integral hangers. See, for example, U.S. Pat. No. 5,135,125 to Andel et al. Additionally, some hanger devices are mechanically secured to an article, such as in the container and retractable hanger system disclosed in U.S. Pat. No. 5,749,497 to Davis.

It is desirable to minimize the cost of any such hanger, particularly in the case of relatively low cost consumer products such as shampoos and the like. However, it is also desirable to provide a hanger which will reliably suspend the article. In the case of hangers consisting of an open hook, there is the risk that the hanger will become dislodged from a support through the open portion of the hook. While closed loop hangers may obviate this risk, they limit the choice of supports to those having a free end over which the hanger may be looped. Commonly, consumers have a number of items in their shower which they wish to hang, but only a few suitable supports for closed loop hangers. Notably, a support having a free end (e.g., a shower head) presents a risk that the hanger may fall off the support.

SUMMARY OF THE INVENTION

The present invention is directed to a label for suspending an article from a support. The label has a lower surface and includes an adhesive on the lower surface to secure the label to the article. The label further includes a hanger defining an opening therein and an interlock tab. The interlock tab is adapted to selectively engage the opening to interlock with the hanger to form a hanging loop including the hanger and the interlock tab.

The label may include a hanger anchoring portion having a lower surface and connected to the hanger, and an interlock tab anchoring portion having a lower surface and connected to the interlock tab. The adhesive is disposed on the lower surfaces of the hanger anchoring portion and the interlock tab anchoring portion to secure the hanger anchoring portion and the interlock tab anchoring portion to the article. Alternatively, the label may include: a base layer having an upper surface and a lower surface, wherein the first adhesive is disposed on the lower surface of the base layer; a suspension layer overlying the base layer, the hanger forming a part of the suspension layer; a hanger anchoring portion forming a part of the suspension layer and being connected to the hanger; and a second adhesive securing the hanger anchoring portion to the upper surface of the base layer.

The present invention is further directed to a suspendable assembly including an article and a label as described above. The adhesive secures the label to the article. The article may include first and second sides, the hanger being mounted on the first side and the interlock tab being mounted on the second side, whereby the hanging loop extends from the first side to the second side. Alternatively, the hanger and the interlock tab may be mounted on the same side of the article.

The present invention is further directed to a method for suspending an article from a support. A label is applied to the article. The label has a lower surface and includes an adhesive on the lower surface securing the label to the article. The label further includes a hanger defining an opening therein, and an interlock tab. The interlock tab is adapted to selectively engage the opening. The hanger is looped over the support and down to the interlock tab. The interlock tab is interlocked with the hanger to form a closed hanging loop extending about the support and to the article.

The step of applying may include: supplying a web of hanger material having the adhesive thereon; applying a portion of the web to the article such that the portion of the web is secured to the article by the adhesive; and simultaneous with or following the step of applying a portion of the web to the article, cutting through the web to form the label.

The present invention is further directed to method for forming a molded suspendable assembly. The method includes molding an article and applying and securing a label to the article during the step of molding. The label includes a hanger defining an opening therein.

The present invention is further directed to a molded suspendable assembly. The molded suspendable assembly includes a molded article and an in-mold label secured to the article. The label includes a hanger defining an opening therein.

Objects of the present invention will be appreciated by those of ordinary skill in the art from a reading of the Figures and the detailed description of the preferred embodiments which follow, such description being merely illustrative of the present invention.

BRIEF DESCRIPTION OF THE DRAWINGS

FIG. 16 is a perspective view of the label of FIG. 10 and the interlock tab member of FIG. 11 mounted on the article and disposed in the second hanging position of FIG. 15, wherein FIG. 16 and FIG. 15 show opposed sides of the article;

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

The term "label" as used herein includes elements or pieces which may be affixed to articles and which may or may not include indicia, including identifying or descriptive indicia, thereon.

Figure 1:
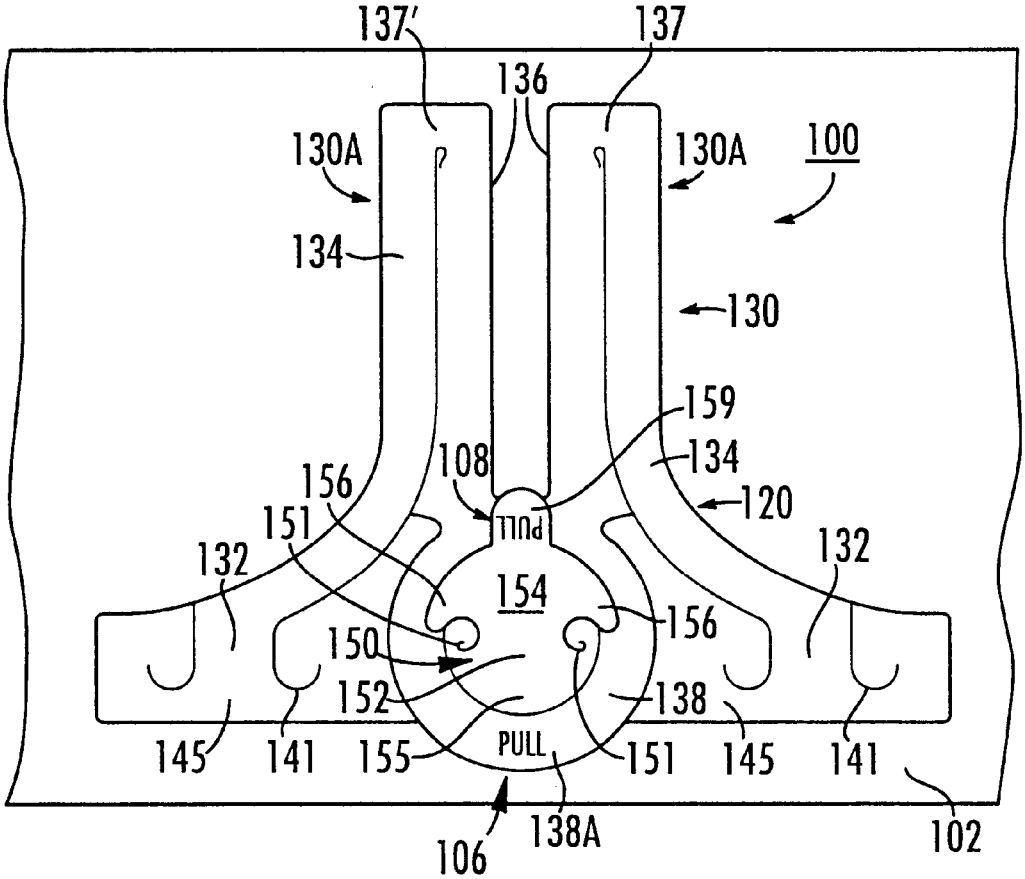
FIG. 1 is a top plan view of a label according to a first embodiment disposed on a release liner.
Figure 2:
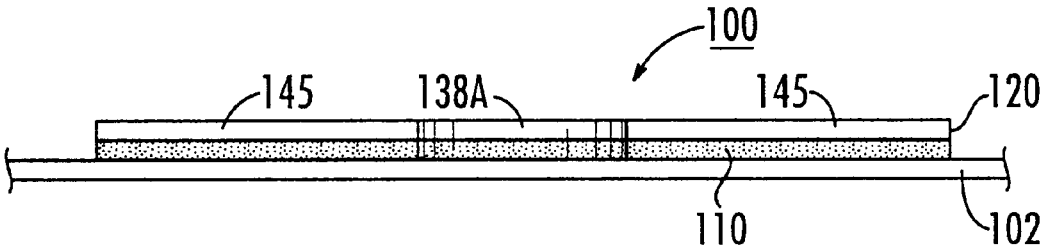
FIG. 2 is a side elevational view of the label of FIG. 1 on the release liner.
Figure 5:
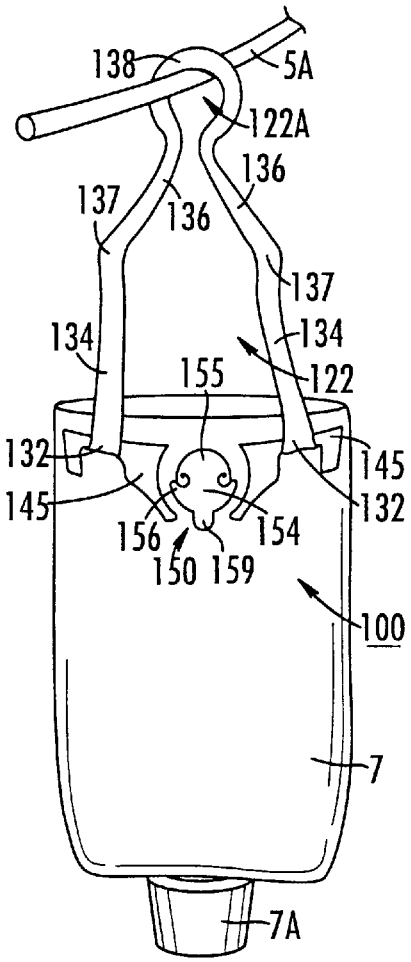
FIG. 5 is a perspective view of the label of FIG. 1 mounted on the article and disposed in a first hanging position.
Figure 6:
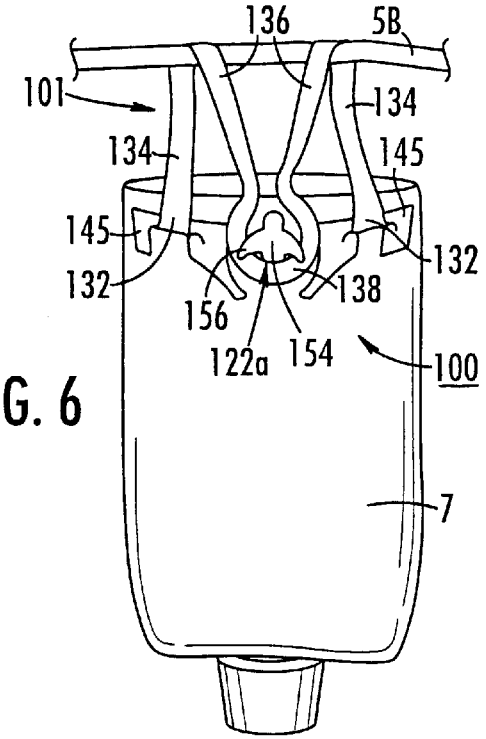
FIG. 6 is a perspective view of the label of FIG. 1 mounted on the article and in a second, alternative hanging position.

With reference to FIGS. 1 and 2, a label 100 according to the present invention is shown therein mounted on a release liner 102. The label includes a suspension layer 120 with a pressure sensitive adhesive 110 on the rear surface thereof (see FIG. 2). The suspension layer 120 includes generally an anchoring portion 145, a hanger 130, and an interlock tab portion 150 (including an anchoring portion 155 and an interlock tab 154). The suspension layer 120 is formed of a continuous layer of material with diecuts formed therein defining the foregoing elements. As will be more fully appreciated by the description that follows, the label 100 may be secured to an article 7 and suspended from a chosen support in either of two different configurations as shown in FIGS. 5 and 6. These different configurations provide the user with substantial versatility in using the label and positioning the article.

Turning to the label 100 in more detail, the hanger 130 includes legs 130A. The legs include segments 134 extending from opposed ends 132. The segments 134 are joined to segments 136 at corners 137. A loop 138 joins the ends of the segments 136. In this manner, the hanger 130 forms a continuous, closed loop from one end 132 to the other end 132. The ends 132 are integral with the anchoring portions 145. The anchoring portions 145 include all of the parts of the suspension layer 120 other than the hanger 130 and the interlock tab portion 150. Diecut stress relief curves 141 are formed at the ends 132. The loop 138 has a pull tab 138A. Indicia 106 instructing a user to "pull" the loop 138 is printed on the pull tab 138A. The suspension layer 120 is formed of a flexible material, and preferably, a flexible film such as a polyethylene or polyester film. Suitable materials for the suspension layer 120 include VALTUFF™ 4 mil polyethylene film and VALEX™ 2.5 mil polyethylene film, both available from Van Leer Films of Houston, Tex.

The interlock tab 154 of the portion 150 has an end 152 integral with the anchoring portion 155. Diecut stress relief curves 151 are formed at the end 152. Integral extensions 156 extend outwardly from the interlock tab 154. A pull tab 159 extends from the interlock tab 154 and has indicia 108 instructing the user to "pull" the pull tab. The tab portion 150 is preferably formed of the same materials as described above for the suspension layer 120.

Figure 3:
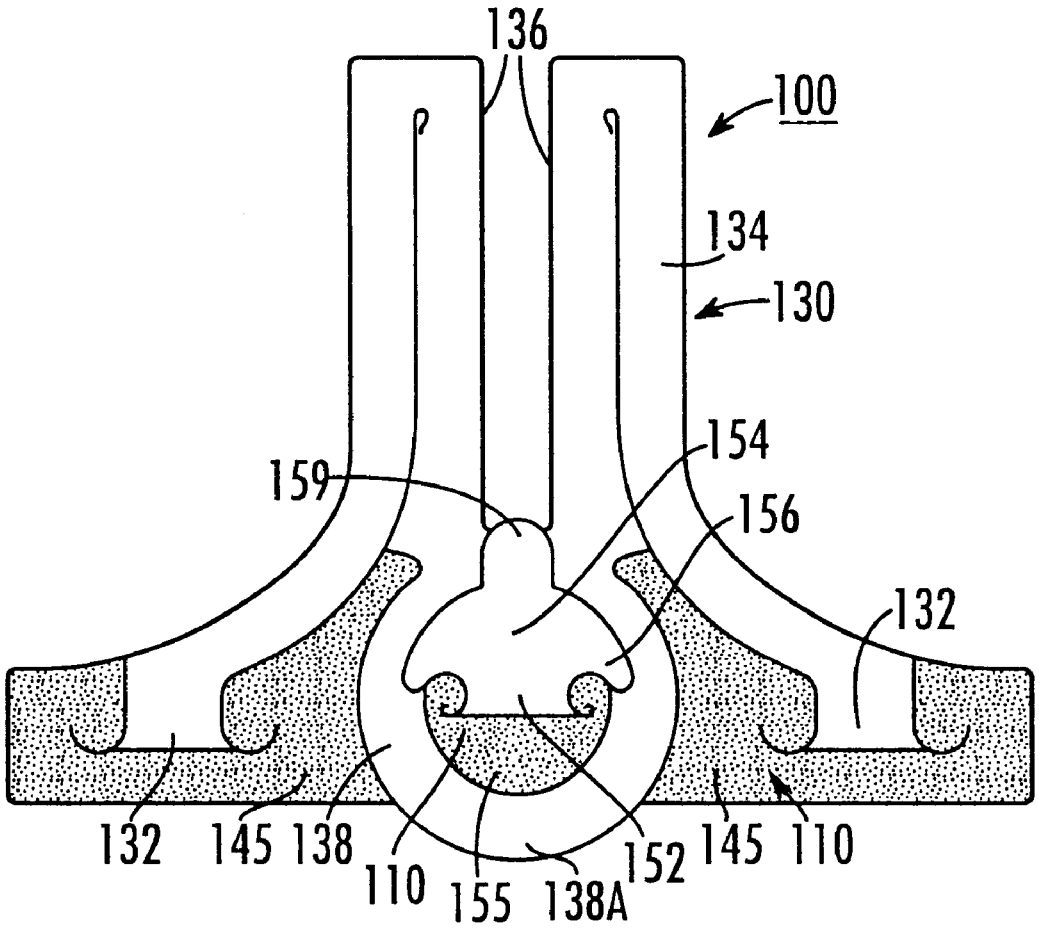
FIG. 3 is a bottom plan view of the label of FIG. 1.

The adhesive 110 coats only a portion of the lower surface of the suspension layer 120. In particular, as shown in FIG. 3, the adhesive 110 coats only the lower surfaces of the anchoring portions 145, 155. Accordingly, the suspension layer 120 may be pivoted away from the remainder of the label 100 about the ends 132, and the tab 154 may be pivoted about the end 152. The adhesive 110 is preferably a pressure sensitive adhesive. The adhesive may also be a heat activatable adhesive. Suitable adhesives include S-3000™ adhesive available from Fasson of Painesville, Ohio.

Figure 4:
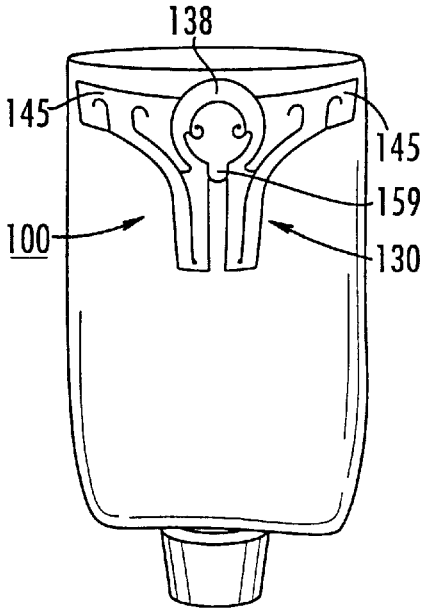
FIG. 4 is a perspective view of the label of FIG. 1 mounted on a article and in a stored position.

In use, the label 100 may be removed from the release liner 102 and applied to an article 7, using automatic labeling equipment, for example. The anchoring portions 145, 155 are adhered to the article 7 by the adhesive 110. For illustrative purposes, the article 7 is a bottle with an end cap 7A. The label 100 may be used with articles of other types and may be oriented differently with respect to the article, depending on the application. When initially applied to the article 7, the label 100 is arranged as shown in FIG. 4 with the hanger 130 and the interlock tab 154 in a stored position against the article 7.

The manner of further use will depend on the type of support from which the user wishes to hang the article 7. If the user intends to hang the article 7 from a support 5A having a free end, such as a shower head, the user pulls the pull tab 138A (see FIG. 1) up and away from the article 7 about the ends 132, thereby unraveling the segments 134, 136. Once unfolded, the hanger 130 defines an opening 122 including a loop opening 122A in the loop 138. The loop 138 is placed over the support 5A to hang the article 7. In this usage, the interlock tab 154 preferably is not deployed.

Alternatively, and with reference to FIG. 6, the label 100 may be used to hang the article 7 from a support 5B of the type not having a free end, such as a towel rack having a wall mount bracket on either end thereof. In this case, the user pulls up the hanger 130 in the same manner as described above. Additionally, the user grasps the pull tab 159 and lifts the interlock tab 154 such that the interlock tab 154 is folded about the end 152. The hanger 130 is then looped over the support 5B and the loop 138 is looped about the interlock tab 154 so that the interlock tab 154 is received in the loop opening 122A. The loop 138 engages the extensions 156 as shown to form an interlock which is maintained by the weight of the article 7. In this manner, the hanger 130 and the interlock tab 154 form a hanging loop 101.

The hanging method and configuration as described above with regard to FIG. 6 may also be used to hang the article 7 from a support such as the support 5A having a free end. Such use may be beneficial where a shorter hanging length is desired. Such use may also be desired when greater resistance to swinging of the article 7 is desired.

From the foregoing, it will be appreciated that the folded configuration of the segments 134, 136 allows for a relatively small footprint label when the hanger is in the stored position while providing a relatively long hanger when deployed. However, it is also contemplated that the legs may consist of single segment legs or that a single leg having an eyelet formed therein may be used.

Figure 7:
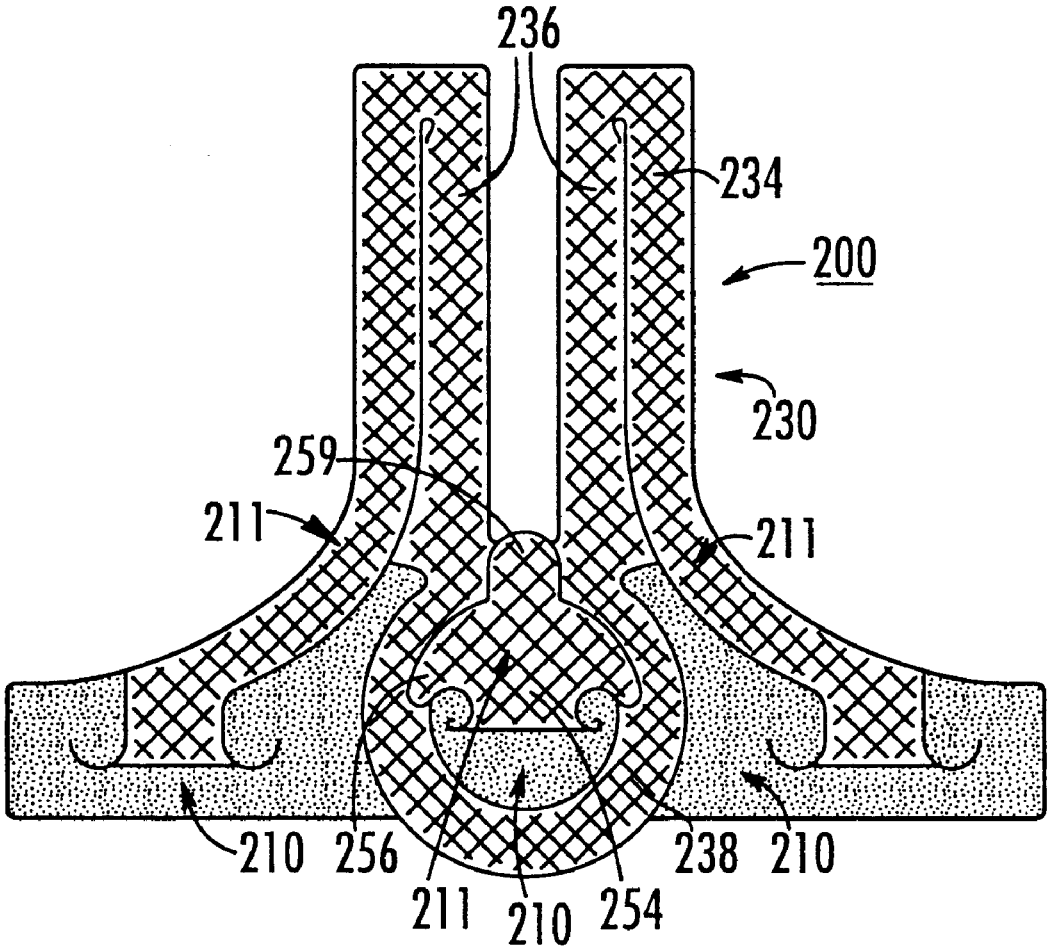
FIG. 7 is a bottom plan view of a label according to a further embodiment.

With reference to FIG. 7, a rear view of a label 200 according to a further embodiment is shown therein. The label 200 corresponds to the label 100 except as follows. Rather than being free of adhesive, the underside of the hanger 230 (i.e., the leg segments 234, 236 and the loop 238) is coated with an adhesive deadener so that a deadened adhesive 211 is presented on the underside. Suitable adhesive deadeners include M800 adhesive deadener from Radcure, Inc. of Fairfield, N.J. and FT33HG adhesive deadener from Northwest Coatings of Oak Creek, Wis. Similarly, the interlock tab 254 (including the extensions 256 and the pull tab 259) is coated on its underside with the deadened adhesive 211. The deadened adhesive 211 does not adhere to the article 7 so that the label 200 may be used in the same manner as described above with regard to the label 100.

As a further alternative (not shown), the adhesive deadener may be replaced with a permanently adhered or releaseable coherent layer such as a web of face stock or a release liner. This layer is preferably only applied over the adhesive present on the hanger 230 and on the tab 254 and serves to prevent exposure of this adhesive.

Figure 8:
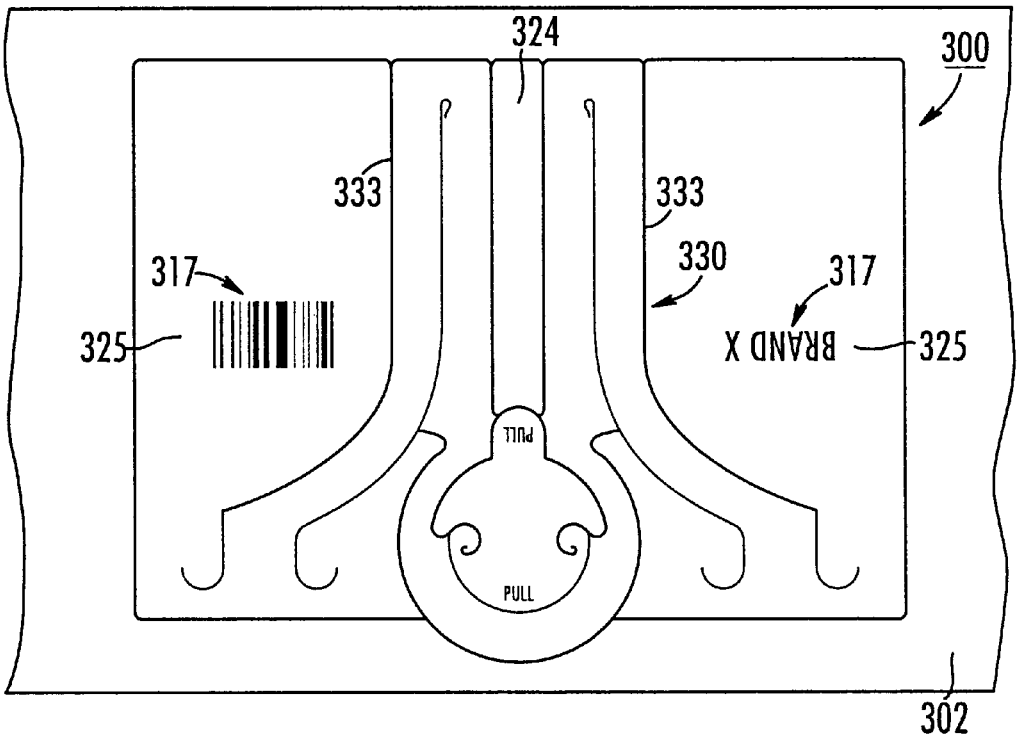
FIG. 8 is a top plan view of a label according to a further embodiment mounted on a release liner.

With reference to FIG. 8, a label 300 according to a further embodiment is shown therein mounted on a release liner 302. The label 300 corresponds to the label 100 except as follows. The anchoring portion is extended to include portions 325 which are separated from the hanger 330 by diecuts 333. Also, a center portion 324 is positioned between the legs of the hanger 330. The center portion 324 and the portions 325 are coated with adhesive corresponding to the adhesive 110. Suitable indicia 317 such as product identification and a bar code are printed on the portions 325.

Figure 9:
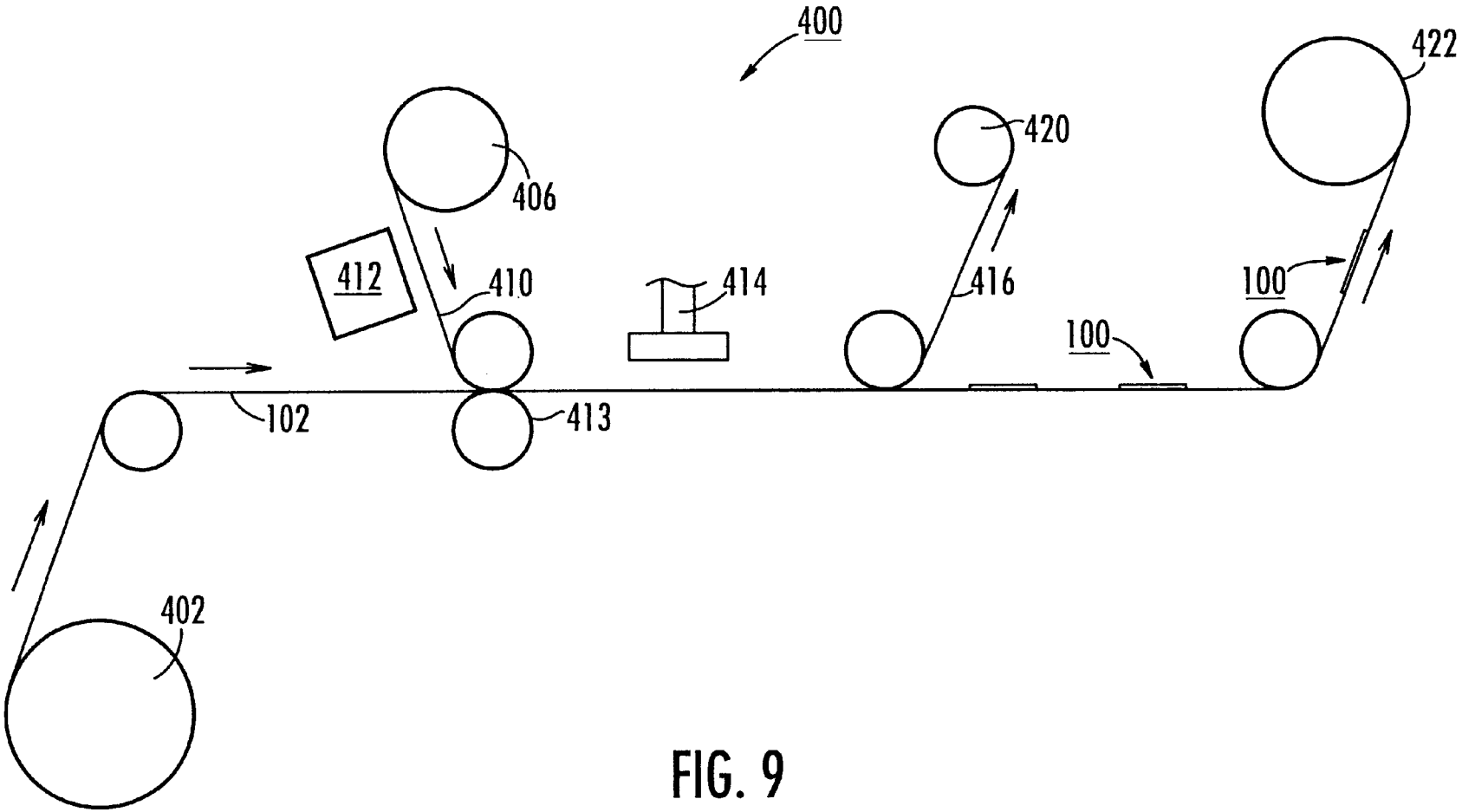
FIG. 9 is a diagram of an apparatus for forming the label of FIG. 1.

With reference to FIG. 9, an apparatus 400 for making the label 100 or the label 300 is shown therein and will be described with reference manufacture of the label 100. The release liner 102 is unwound from an unwinding station 402. A non-adhesive web 410 of material corresponding to the suspension layer 120 is unwound from an unwinding station 406. An adhesive print station 412 prints the adhesive 110 in the appropriate pattern on the underside of the web 410. The adhesive coated surface of the web 410 is married to the release liner 102 by nip rollers 413. A diecut station 414 forms the diecuts of the label 100 as well as the periphery of the label 100. A waste matrix 416 including the portion of the web 410 outside of the label 100 is taken away by a winding station 420. The labels 100 are then wound onto a roll at a winding station 422.

The method and apparatus as described above may be used to make the label 200 with suitable modifications. In particular, the web 410 is replaced with a self-adhesive web (which may be provided as a release liner backed face stock, whereupon the release liner would first be removed) and the adhesive print station 412 is replaced with an adhesive deadener printing station which prints the appropriate pattern of adhesive deadener.

Figure 10:
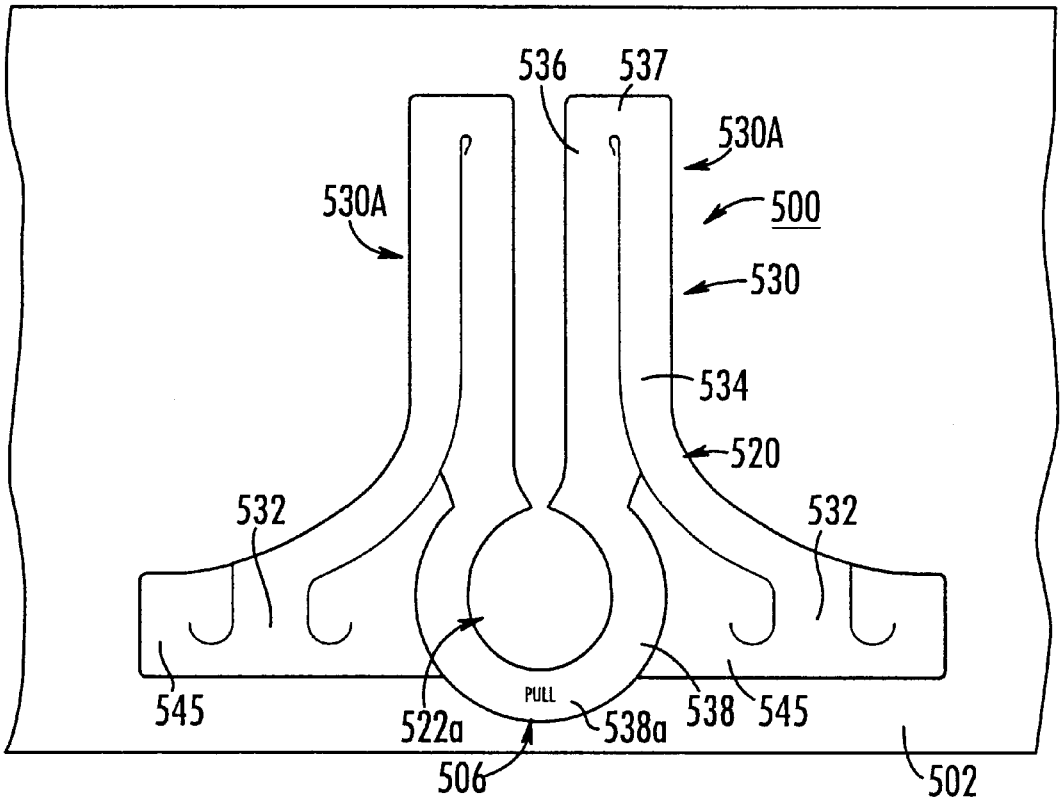
FIG. 10 is a top plan view of a label according to a further embodiment mounted on a release liner.
Figure 11:
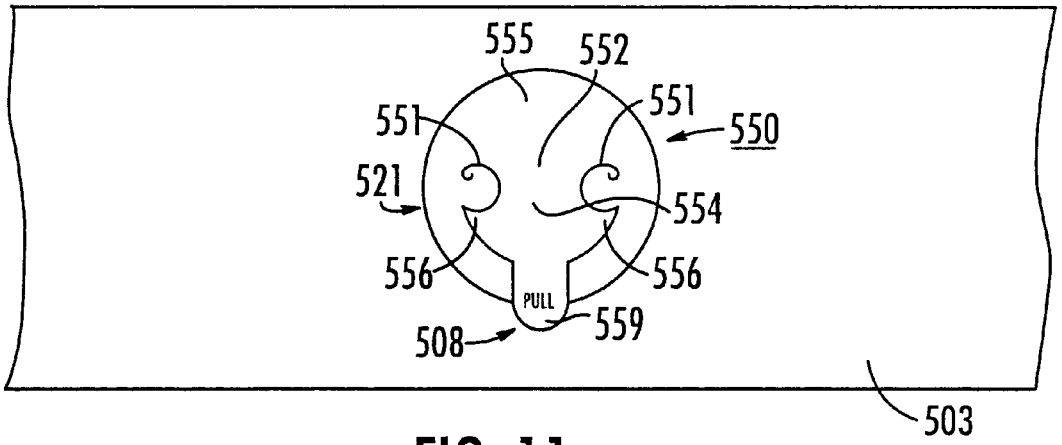
FIG. 11 is a top plan view of an interlock tab member associated with the label of FIG. 10 and mounted on a release liner.
Figure 12:
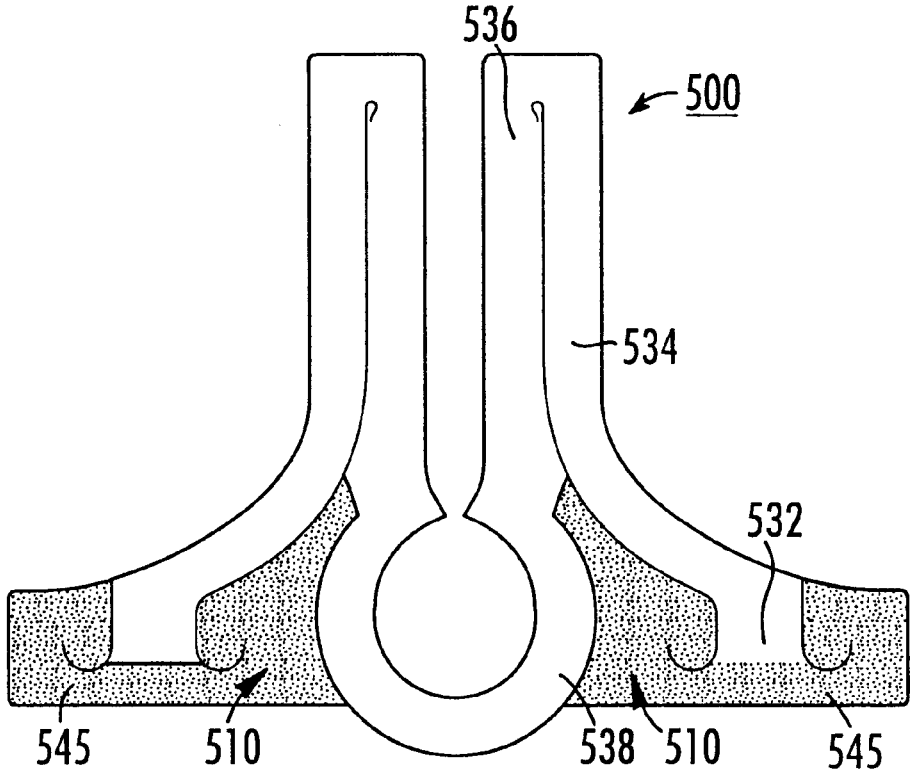
FIG. 12 is a bottom plan view of the label of FIG. 10.
Figure 13:
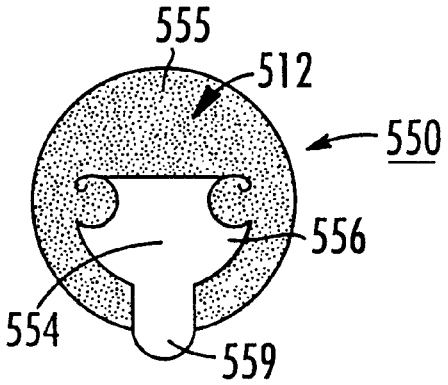
FIG. 13 is a bottom plan view of the interlock tab member of FIG. 11.

With reference to FIGS. 10 and 11, a label 500 according to a further embodiment is shown therein disposed on a release liner 502 and an interlock tab member 550 is shown therein mounted on a release liner 503. The label 500 and the tab member 550 are constructed in the same manner as the label 100 except that the tab member 550 is separately formed from the label 500. The label 500 includes elements 506, 520, 522A, 530, 530A, 532, 534, 536, 537, 538, 538A, and 545 corresponding to elements 106, 120, 122A, 130, 130A, 132, 134, 136, 137, 138, 138A, and 145, respectively. The tab member 550 includes a suspension layer 521 corresponding to the portion of the suspension layer 120 forming the interlock tab portion 150. The tab member 550 also includes elements 508, 551, 552, 554, 555, 556, and 559 corresponding to elements 108, 151, 152, 154, 155, 156, and 159, respectively. Notably, the loop 538 and the extensions 556 are shaped differently from the corresponding components of the label 100. The separate formation of the label 500 and the tab member 550 allows the loop 538 and the extensions 156 to be made smaller. FIGS. 12 and 13 show the pattern of the adhesive 510 and the adhesive 512 on the rear surface of the label 500 and the tab member 550, respectively. The label 500 and the tab member 550 may be formed with deadened adhesive in place of the omitted adhesive, as discussed above with regard to the label 200.

Figure 14:
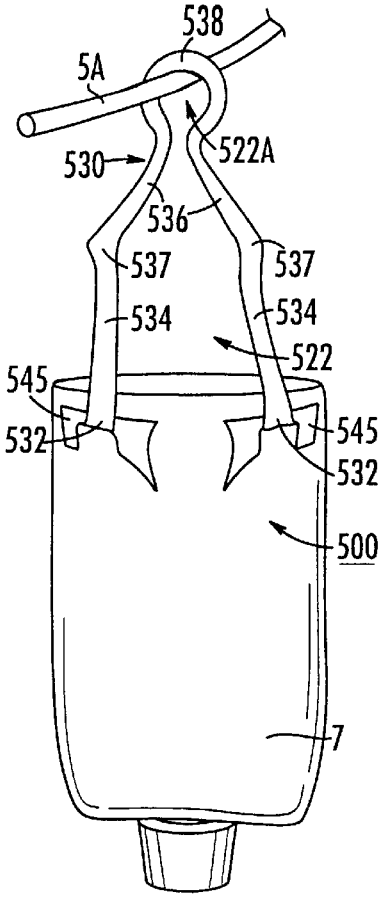
FIG. 14 is a perspective view of the label of FIG. 10 mounted on an article and disposed in a first hanging position.
Figure 15:
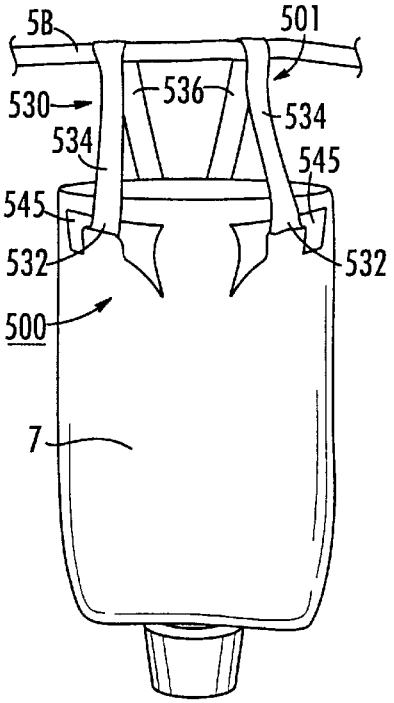
FIG. 15 is a perspective view of the hanger of FIG. 10 mounted on the article and disposed in a second, alternative hanging position.
Figure 16:
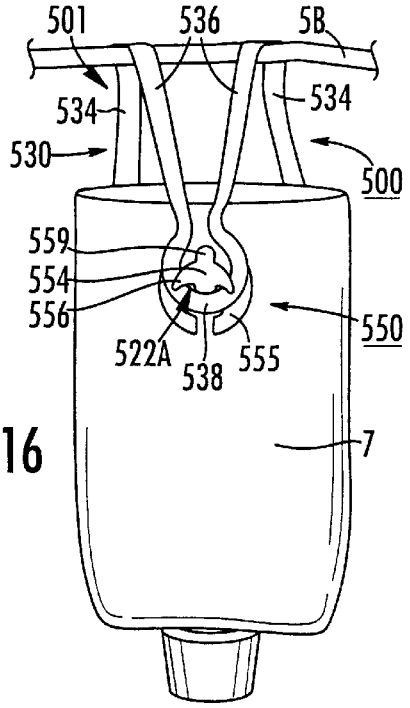
Figure 17:
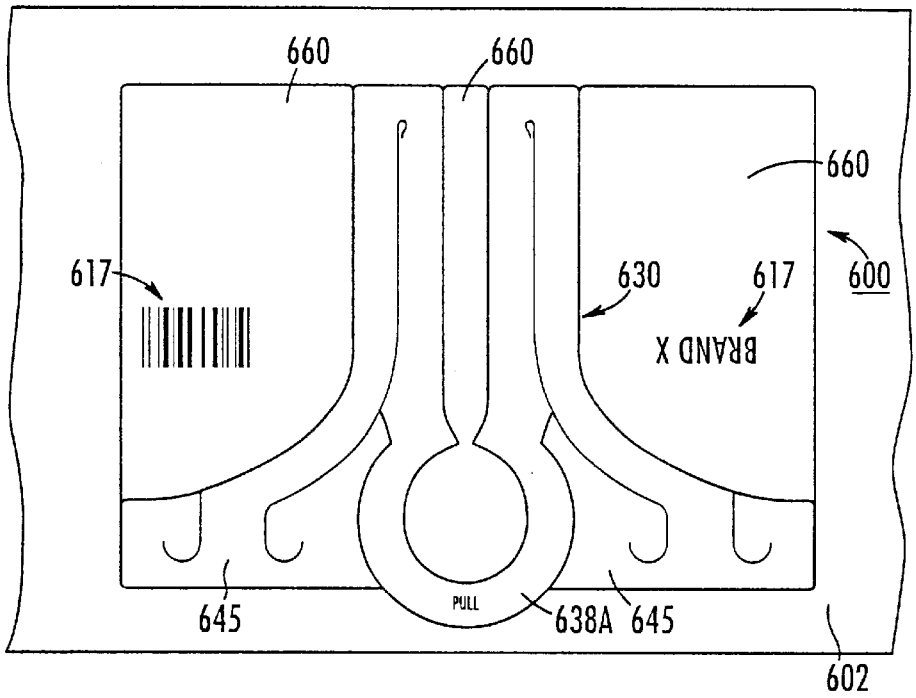
FIG. 17 is a top plan view of a label according to a further embodiment mounted on a release liner.
Figure 18:
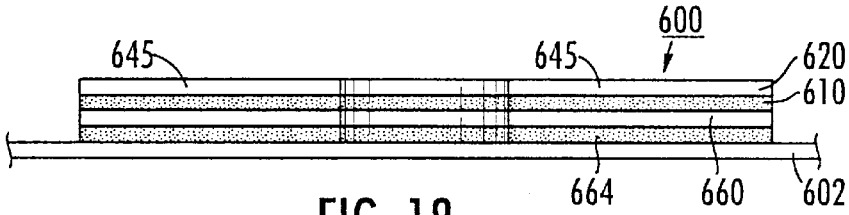
FIG. 18 is a side elevational view of the label of FIG. 17 mounted on the release liner.
Figure 19:
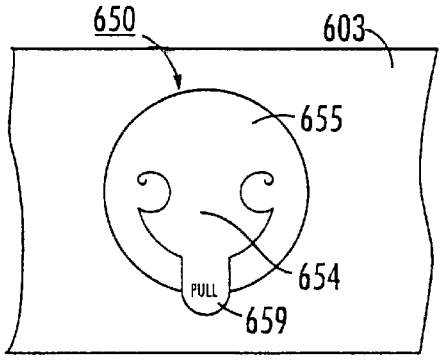
FIG. 19 is a top plan view of an interlock tab member associated with the label of FIG. 17 and mounted on a release liner.
Figure 20:
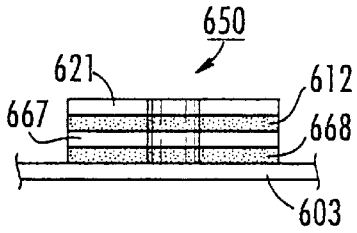
FIG. 20 is a side elevational view of the interlock tab member of FIG. 19 mounted on the release liner.

With reference to FIGS. 14–16, the label 500 and the tab member 550 may be mounted and used in a manner similar to that of label 100. The label 500 and the tab member 550 may each be mounted using suitable equipment. Preferably, the label 500 and the tab member 550 are mounted on opposite sides of the article 7 as illustrated. The label 500 and the tab member 550 may also be mounted on the same side of the article 7. The hanger 530 and the interlock tab 554 remain in the stored position (as shown in FIGS. 10 and 11) until the user wishes to suspend the article 7 from a support 5A or a support 5B. If the user wishes to suspend the article 7 from the support 5A having a free end, the user lifts the hanger 530 and places the loop 538 over the support 5A as shown in FIG. 14. If the user desires to mount the article 7 on the support 5B in the manner shown in FIG. 16, the user lifts and folds the interlock tab 554 about the end 552 (not visible in FIG. 16). The user then lifts the loop 530 over the support 5B and to the opposite side of the article 7. The user places the loop 538 about the interlock tab 554 so that the loop 538 interlocks with the extensions 556 to form a hanging loop 501.

The label 500 allows selective placement of the tab member 550 in a position on the article 7 which increases the stability of the hanging article 7. Also, the label 500 and the tab member 550 allow greater flexibility in arranging the hanging configuration. Multiple tab members 550 may be provided and mounted on the article 7 to allow selection between different hanging lengths.

With reference to FIGS. 17–20, a label 600 is shown therein mounted on a release liner 602 and a tab member 650 is shown mounted on a release liner 603. The label 600 and the tab member 650 have elements 630, 645, 654, and 655 corresponding to the elements 530, 545, 554, and 555, respectively, and are similar to the label 500 and the tab member 550, respectively, except that the label 600 and the tab member 615 include multiple plies. The suspension layer 620 corresponds to the suspension layer 520 and is adhered to a base layer 660 by adhesive 610. The base layer 660 includes indicia 617 which may include product identification and a bar code. The base layer 660 is in turn releaseably adhered to the release liner 602 by an adhesive layer 664. Similarly, the suspension layer 621 corresponds to the layer 521 and is adhered to a base layer 667 by an adhesive layer 612. The base layer 667 is in turn releaseably adhered to the release liner 603 by an adhesive layer 668. Suitable adhesives for adhesive layers 664 and 668 include B-122 adhesive from Brownbridge Industries of Ohio. The preferred materials of the adhesives 610 and 612 will depend on the material of the base layers 660 and 667. Suitable adhesives may include S-3000 adhesive available from Fasson. Suitable materials for the base layers 660, 667 include 2.3 mil biaxially oriented polypropylene from Brownbridge industries or polyester film.

The label 600 and the tab member 650 may be formed in two alternative constructions. According to the first construction, the entire layer 620 or 621 is adhered to the upper surface of the corresponding base layers 660, 667 and the adhesive 664, 668 coats the entire underside of the base layer 660, 667 except beneath the hanger 630 or the tab 654. The layers 620, 610, 660 and 664 or the layers 621, 612, 667, and 668 are diecut fully through to the upper surface of the release liner 602, 603. Thus, the hanger 630 which may be lifted away from the article to which the label 600 is applied will include two plies, namely, the ply formed from the layer 620 and a ply formed from the layer 660. Similarly, the interlock tab 654 will include two plies, namely, a ply formed from the layer 621 and a ply formed from the layer 667.

Methods and apparatus for forming a label constructed as just described will be apparent to those of skill in the art upon a reading of the foregoing description as well as the description regarding the manufacture of the label 100. For example, the web 410 (see FIG. 9) may be replaced with a composite web including a web corresponding to the layer 620, a web corresponding to the layer 660, for example, and an adhesive corresponding to the adhesive 610 securing the webs to one another. The adhesive print station applies adhesive to the underside of the web corresponding to the layer 660.

According to a second, alternative construction, the label 600 and the tab member 650 may have diecuts only down to the upper surface of the base layer 660, 667. In this case, the adhesive 664, 668 fully coats the underside of the respective base layer 660, 667. The adhesive layers 610 and 612 have the same pattern as described above with regard to the adhesive layers 510 and 512, respectively. The pull tabs 638A, 659 may have a multi-ply construction with a lower ply formed from the base layer 660, 667 as described with respect to FIG. 13 of applicant's U.S. Pat. No. 5,738,381, the disclosure of which is hereby incorporated herein in its entirety.

The method and apparatus for manufacturing the label according to the second, alternative construction may be similar to the method and apparatus described above with regard to the label 100 except as follows. The release liner 102 is replaced with a composite web including the release liner 102, a web corresponding to the base layer 660 or 667, and a layer of adhesive corresponding to the adhesive 664 or 668 therebetween. The diecut step includes cutting the cut lines which form the hanger 630 and the tab 654 down to the upper surface of the web corresponding to the base layer 660, 667 and cutting down to the release liner 602, 603 about the periphery of the label 600 or the tab member 650.

The two ply constructions as just described may also be used in a label having a configuration like that of the label 100. Suitable modifications to the label 100 will be readily apparent to those of skill in the art upon a reading of the foregoing description. Additionally, an adhesive deadener may be used in the label 600 and the tab member 650 in place of the omitted adhesive.

Figure 21:
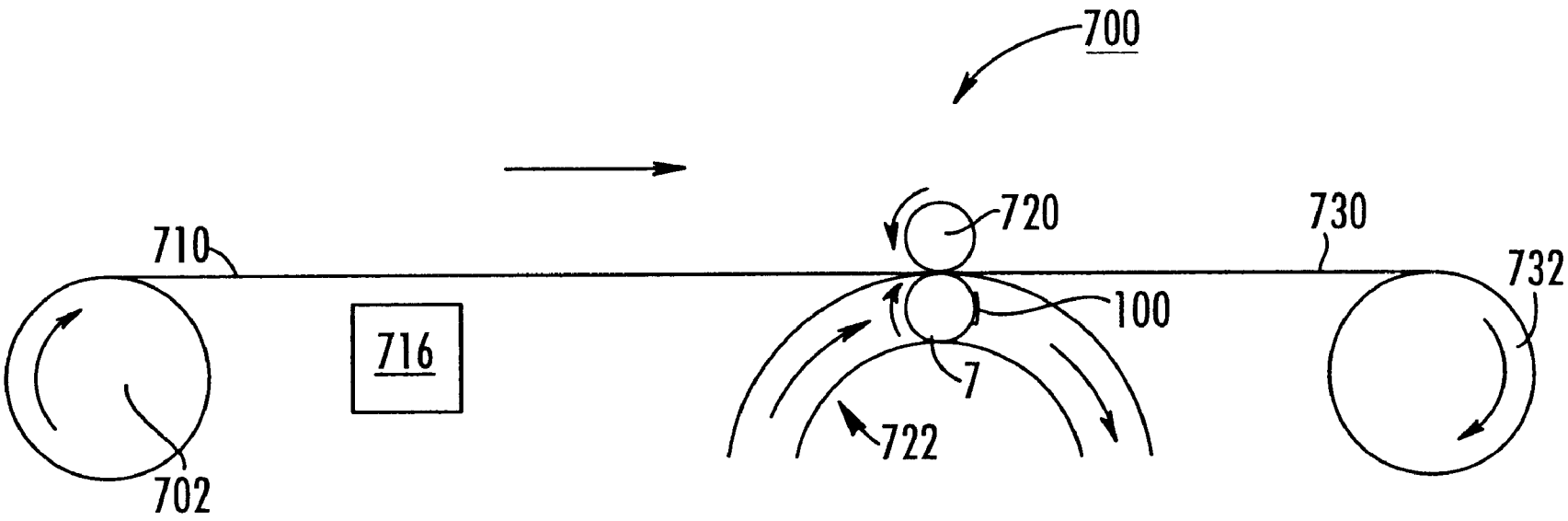
FIG. 21 is a diagram of an apparatus for forming and applying cut labels according to the embodiment of FIG. 1.

With reference to FIG. 21, labels corresponding to each of the labels 100–600 or tab members corresponding to any of the tab members 550, 650 may be provided as "cut labels", i.e., labels which are applied directly to articles without first being mounted on a release liner. The manufacture and application of such a label will be described below with regard to the label 100, however, suitable modifications to the described method and apparatus as appropriate for forming the other labels and interlock tab members as described above will be apparent to those of skill in the art upon reading the description herein.

A web 710 corresponding to the suspension layer 120 is unwound from an unwinding station 702. As the web 710 passes by an adhesive print station 716, the pattern of adhesive corresponding to the adhesive 110 is printed on the underside thereof. The article 7 travels down a lane 722 in the direction indicated. As the article 7 meets the web 710, a die cutter 720 rotating in a counterclockwise direction and using the article 7 as a backing surface, cuts through the web 710 to form the label 100. Notably, the die cut is registered with the printed pattern of adhesive from the adhesive print station 716. The article 7 is rotated in a clockwise direction so that the label 100 is taken onto the article's outer surface and the label 100 is adhered to the article 7 by the adhesive from the adhesive print station 716. A waste web 730 including the portions of the web 710 and the adhesive (if any) outside of the die cut is wound onto a winding stand 732.

Any of the foregoing suspension layers of the labels 100, 200, 300, 400, 500, and 600 and the tab members 550 and 650 may be constructed in a multi-ply construction as described in applicant's U.S. Pat. No. 5,878,901, the disclosure of which is hereby incorporated herein by reference in its entirety. In a two-ply suspension layer, the second ply is preferably a polyester layer secured to the first ply (constructed as described above) by S-3000 adhesive.

Figure 22:
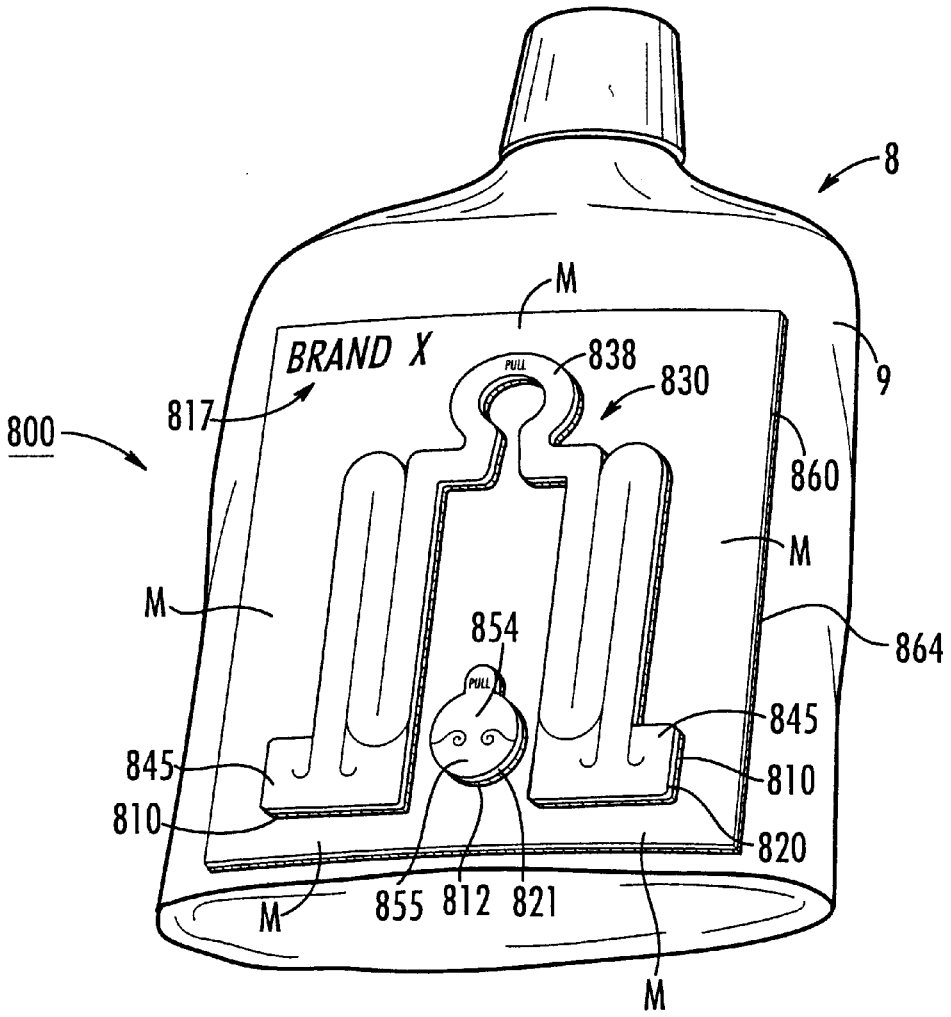
FIG. 22 is a perspective view of a molded suspendable assembly including a label according to a further embodiment.

With reference to FIG. 22, a label 800 according to a further embodiment is shown therein mounted on a molded article (a container in the illustrated embodiment) 9 to form a molded suspendable assembly 8. The label 800 includes a base layer 860. Suitable indicia 817 is printed on the base layer. The base layer 860 is adhered to the outer surface of the article 9 by an adhesive 864. A suspension layer 820 is secured to the upper surface of the base layer 860 by adhesive patches 810. The layer 820 includes a hanger 830, a loop 838 and hanger anchoring portions 845 generally corresponding to the elements 130, 138, and 145, respectively. Only the anchoring portions 845 are secured to the base layer 860 by the adhesive 810. Similarly, a suspension layer 821 is secured to the upper surface of the base layer 860 by an adhesive patch 812. The layer 821 includes an interlock tab 854 and an anchoring portion 855 generally corresponding to the elements 154 and 155, respectively. Only the anchoring portion 855 is secured to the base layer by the adhesive 810. Notably, a margin M of the base layer 860 surrounds the suspension layers 820, 821. Optionally, the anchoring portions 845, 855 may extend to the periphery of the base layer 860. However, it is preferred that the hanger 830 and tab 845 be spaced from the edges of the base layer, as discussed below.

The label 800 is applied to the article 9 during the molding thereof using any suitable in-mold labeling technique. The label 800 may be supplied from a cut stock or roll of such labels. Typically, the label 800 (i.e., elements 810, 812, 820, 821, 860 and 864) will be placed in the mold, either on the mold wall or on the mold stock, prior to the molding step. If necessary, a recess in the mold wall or other accommodation for the label 800 may be made. The molding process may be any suitable molding process such as blow molding or injection molding. Suitable in-mold labeling techniques and materials will be apparent to those of skill in the art upon reading the description herein.

The base layer 860 is formed of a material suitable for in-mold labeling with the article 9, i.e., a material which will adequately bond with the material of the article 9 as the article 9 is being formed in a molding process. Suitable materials may include a preformed material including a material corresponding to the base layer 860 coated with a suitable adhesive corresponding to the adhesive 864. Suitable materials of this type include an in-mold label stock from Fasson such as 4 mil FASCLEAR IN-MOLD™ material (product no. 72854) with a heat activatable adhesive. Alternatively, a web of suitable base layer material, preferably a biaxially oriented polypropylene film, is coated with a suitable adhesive such as that found on the FASCLEAR IN-MOLD™ material. The adhesive layer 864 may be heat and/or pressure activated in the mold. The adhesives 810, 812 and the layers 820, 821 are formed of suitable materials to ensure that the anchoring portions 845, 855 are adequately secured (for suspending the container) to the base layer 860 following the molding process. Preferably, the melting point of the adhesives 810, 812 will be high enough as compared the molding temperature to ensure that the adhesives 811, 812 maintain the anchoring portions 845, 855 in position on the base layer 860 throughout the molding process. The suspension layers 820, 821 should be formed of a material which will not substantially bond with the base layer 860 as a result of the molding process. Preferably, the layers 820, 821 are formed of a material which will not bond at all with the base layer 860 as a result of the molding process. However, in some applications, it may be desirable to allow a small amount of bonding to temporarily hold the hanger 830 and/or the tab 854 down until needed.

It is also contemplated that the base layer 860 may be secured to the article 9 by means other than an adhesive such as the adhesive layer 864. For example, by selection of an appropriate material for the base layer, the base layer may be mechanically bonded to the article 9 by the in-mold labelling process.

Because the label 800 includes separate layers for bonding to the article 9 and for forming the hanger 830 and the tab 854, the materials for these components may be chosen as appropriate for their respective functions. Because the hanger 830 and the tab 854 are not adhered to the base layer 860, they may be deployed in the manner described above. It will be appreciated that various other aspects and modifications as described above with regard to other embodiments of the invention may be applied to the label 800 as well. Moreover, it is contemplated that the tab 854 and the associated adhesive 812 (and, hence, the advantages thereof) may be omitted.

The margin M ensures that the hanger 830 and the tab 854 will not become inadvertently bonded to the article 9 as a result of the molding process. However, in some applications, it may be desirable to allow a portion of the hanger 830 or the tab 854 to extend along or beyond the edge of the base layer 860 to allow some bonding of the hanger 830 or the tab 854 to the article 9 to temporarily hold the hanger 830 and/or the tab 854 down until needed.

While the labels as shown in the drawings and described above include multiple legs, it is also contemplated that the labels may be modified to include a single leg having an eyelet or opening corresponding to the opening 122A, for example. Other hanger configurations may be employed as well. For example, the interlock tab may be longer than the hanger so that the interlock tab (e.g., 154) may be looped around a support and engaged with a loop (e.g., the loop 138) which extends a relatively short distance from the article.

Any of the foregoing labels may include indicia as desired printed on the layers from which the hanger or base tab are formed. Such indicia may include product identification, instructions, warnings, lot data, expiration data, and bar codes.

If desired, small patches of adhesive may be provided on the underside of the hangers and interlock tabs to temporarily secure these elements to the article or base layer, if present. Such adhesive patches would preferably be provided under the segment corners (e.g., the corners 137) and the pull tabs.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

What is claimed is:

1. A label for suspending an article from a support, said label having a lower surface and comprising:

a) an adhesive on said lower surface to secure said label to the article;

b) a hanger defining an opening therein; and c) an interlock tab adapted to selectively engage said opening to interlock with said hanger to form a hanging loop including said hanger and said interlock tab.

2. The label of claim 1 releaseably secured to a release liner by said adhesive.

3. The label of claim 1 wherein, when said label is mounted on the article, said hanger is transitionable between a stored position wherein said hanger is disposed adjacent the article and a hanging position wherein said hanger is folded away from the article.

4. The label of claim 3 wherein said hanger includes a plurality of connected, folded segments and said hanger is transitioned from said stored position to said hanging position by unfolding said segments.

5. The label of claim 3 wherein said interlock tab is disposed within said opening of said hanger when said hanger is in said stored position.

6. The label of claim 1 wherein, when said label is mounted on the article, said interlock tab is transitionable between a stored position wherein said interlock tab is disposed adjacent the article and an interlocking position wherein said interlock tab is folded away from the article.

7. The label of claim 1 wherein said hanger and said interlock tab are formed from cut lines in a unitary suspension layer.

8. The label of claim 1 wherein said hanger and said interlock tab are separately formed.

9. The label of claim 1 including indicia disposed thereon.

10. The label of claim 1 including:

a hanger anchoring portion having a lower surface and connected to said hanger; and an interlock tab anchoring portion having a lower surface and connected to said interlock tab;

wherein said adhesive is disposed on said lower surfaces of said hanger anchoring portion and said interlock tab anchoring portion to secure said hanger anchoring portion and said interlock tab anchoring portion to the article.

11. The label of claim 10 wherein the lower surfaces of said hanger and said interlock tab are substantially free of adhesive.

12. The label of claim 11 wherein the lower surfaces of said hanger and said interlock tab are coated with a deadened adhesive.

13. The label of claim 1 wherein said interlock tab includes at least two opposed extensions adapted to engage said hanger.

14. The label of claim 1 wherein at least said hanger includes a plurality of layers adhered to one another.

15. The label of claim 1 including:

a base layer having an upper surface and a lower surface, wherein said adhesive is disposed on said lower surface of said base layer;

a suspension layer overlying said base layer, said hanger forming a part of said suspension layer;

a hanger anchoring portion forming a part of said suspension layer and being connected to said hanger; and a second adhesive securing said hanger anchoring portion to said upper surface of said base layer.

16. The label of claim 15 including an interlock tab anchoring portion forming a part of said suspension layer and being connected to said interlock tab, said second adhesive securing said interlock tab anchoring portion to said upper surface of said base layer.

17. A label for suspending an article from a support, said label having a lower surface and comprising:

a) an adhesive on said lower surface to secure said label to the article;

b) a hanger defining an opening therein, said hanger including a plurality of connected, folded segments; and c) an interlock tab adapted to selectively engage said opening to interlock with said hanger to form a hanging loop including said hanger and said interlock tab;

d) wherein said hanger is adapted to be folded away from the article when said label is mounted on the article; and e) wherein said interlock tab is adapted to be folded away from the article when said label is mounted on the article.

18. The label of claim 17 wherein said hanger and said interlock tab are each adapted to be placed in a stored position when said label is mounted on the article, and wherein said hanger and said interlock tab are disposed adjacent the article and said interlock tab is disposed within said opening of said hanger when said hanger and said interlock tab are in said stored position.

19. The label of claim 17 wherein said hanger and said interlock tab are formed from cut lines in a unitary suspension layer.

20. The label of claim 17 wherein said hanger and said interlock tab are separately formed.

21. The label of claim 17 including indicia disposed thereon.

22. The label of claim 17 including:

a hanger anchoring portion having a lower surface and connected to said hanger; and an interlock tab anchoring portion having a lower surface and connected to said interlock tab;

wherein said adhesive is disposed on said lower surfaces of said hanger anchoring portion and said interlock tab anchoring portion to secure said hanger anchoring portion and said interlock tab anchoring portion to the article.

23. The label of claim 17 wherein said interlock tab includes at least two opposed extensions adapted to engage said hanger.

24. The label of claim 17 including:

a base layer having an upper surface and a lower surface, wherein said adhesive is disposed on said lower surface of said base layer;

a suspension layer overlying said base layer, said hanger forming a part of said suspension layer;

a hanger anchoring portion forming a part of said suspension layer and being connected to said hanger;

an interlock tab anchoring portion forming a part of said suspension layer and being connected to said interlock tab; and a second adhesive securing said hanger anchoring portion and said interlock tab anchoring portion to said upper surface of said base layer.

* * * * *